US011850847B2

(12) United States Patent
Okushima et al.

(10) Patent No.: US 11,850,847 B2
(45) Date of Patent: Dec. 26, 2023

(54) INKJET PRINTING APPARATUS AND INKJET PRINTING METHOD

(71) Applicant: SCREEN HOLDINGS CO., LTD., Kyoto (JP)

(72) Inventors: Tomoyasu Okushima, Kyoto (JP); Ippei Matsumoto, Kyoto (JP); Yuta Ikeda, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 4 days.

(21) Appl. No.: 17/385,593

(22) Filed: Jul. 26, 2021

(65) Prior Publication Data

US 2022/0080727 A1 Mar. 17, 2022

(30) Foreign Application Priority Data

Sep. 11, 2020 (JP) ..... 2020-153304

(51) Int. Cl.
*B41J 2/045* (2006.01)
*B41J 11/42* (2006.01)

(52) U.S. Cl.
CPC ..... *B41J 2/04573* (2013.01); *B41J 2/04536* (2013.01); *B41J 2/04581* (2013.01); *B41J 11/42* (2013.01)

(58) Field of Classification Search
None
See application file for complete search history.

(56) References Cited

U.S. PATENT DOCUMENTS 7,625,055 B2 * 12/2009 Furuya ..... B41J 11/008 347/14
2013/0335470 A1 12/2013 Saitou
2015/0266326 A1 9/2015 Nieda
2017/0225494 A1 * 8/2017 Tokunaga ..... B41J 11/006

FOREIGN PATENT DOCUMENTS

EP 2 927 004 A1 10/2015
EP 3 437 871 A1 2/2019
EP 3437871 A1 * 2/2019 ..... B41J 11/007
WO 2017/169237 A1 10/2017

OTHER PUBLICATIONS

Extended European Search Report issued in corresponding European Patent Application No. 21188026.5-1017, dated Jan. 19, 2022.

* cited by examiner

*Primary Examiner* — Scott A Richmond
(74) *Attorney, Agent, or Firm* — Rimon, P.C.

(57) ABSTRACT

An inkjet printing apparatus includes a head that ejects ink toward a recording medium transported by a transport unit, and an ejection controller that causes the head to eject ink. The ejection controller is configured to perform process including: process of calculating a transport speed of the recording medium; process of generating reference timing of ejection of ink by the head; process of determining a target delay amount by which timing of ejection of ink by the head is delayed from the reference timing on the basis of a transport speed coinciding with the reference timing; process of updating a target delay amount, on the occurrence of change in the transport speed before the recording medium is transported by a distance corresponding to the target delay amount, the target delay amount being updated in response to the transport speed as changed; and process of delaying timing of ejection of ink by the head on the basis of the target delay amount as updated.

11 Claims, 10 Drawing Sheets

Fig. 5

61

| TRANSPORT SPEED | TARGET DELAY AMOUNT |
|---|---|
| ... | ... |
| 37 – 42 mpm | 20 PULSES |
| 42 – 47 mpm | 19 PULSES |
| 47 – 52 mpm | 18 PULSES |
| 52 – 57 mpm | 17 PULSES |
| 57 – 62 mpm | 16 PULSES |
| 62 – 67 mpm | 15 PULSES |
| ... | ... |

INKJET PRINTING APPARATUS AND INKJET PRINTING METHOD

RELATED APPLICATIONS

This application claims the benefit of Japanese Application No. 2020-153304, filed on Sep. 11, 2020, the disclosure of which is incorporated by reference herein.

BACKGROUND OF THE INVENTION

Field of the Invention

The present invention relates to an inkjet printing apparatus and an inkjet printing method.

Description of the Background Art

In one inkjet printing apparatus used for recording an image on a recording medium, ink is ejected periodically from a nozzle on a recording medium transported in a predetermined transport direction. In the inkjet printing apparatus, ink is ejected by following timing of when an ejection intended position of the ink on the recording medium is moved to a predetermined ejection reference position as viewed in a transport direction. By doing so, droplets of the ink are caused to land at appropriate intervals as viewed in the transport direction, thereby forming a proper image.

In the inkjet printing apparatus, an image is normally recorded while the recording medium is transported at a constant speed. On the occurrence of change in a transport speed of the recording medium, timing of ejection of ink is adjusted in such a manner as to eject the ink by following timing of when the ejection intended position on the recording medium is moved to the ejection reference position described above.

If a transport speed of the recording medium changes during printing, a distance of movement of the recording medium changes during flight time from ejection of ink from an ink ejector to landing of the ink on the recording medium. Specifically, on the occurrence of change in the distance of movement of the recording medium during the flight time, a landing position of the ink is displaced to degrade image quality. According to PCT International Publication No. 2017/169237, the ink ejector ejects ink by following timing of when delay time responsive to a transport speed of the recording medium coinciding with ejection reference timing has passed since the ejection reference timing of when the ejection intended position of the ink on the recording medium moved to the ejection reference position.

SUMMARY OF THE INVENTION

Technical Problem

According to PCT International Publication No. 2017/169237, however, the delay time is determined on the basis of a transport speed coinciding with the ejection reference timing. Hence, if a transport speed changes after the ejection reference timing to change a distance of movement of the recording medium during the flight time, difficulty may be caused in compensating for a landing position of ink.

Solution to Problem

The present invention is intended to provide a technique of compensating for a landing position of ink appropriately in response to change in a transport speed.

The present invention is directed to an inkjet printing apparatus.

According to the present invention, the inkjet printing apparatus includes: a transport unit that transports a recording medium in a prescribed transport direction; an ink ejector that ejects ink toward the recording medium transported by the transport unit; and an ejection controller that causes the ink ejector to eject ink. The ejection controller performs process including: speed calculation process of calculating a transport speed of the recording medium; reference timing generation process of generating reference timing of ejection of ink by the ink ejector; target delay amount determination process of determining a target delay amount corresponding to a transport distance of the recording medium in a period from generation of the reference timing to ejection of ink by the ink ejector on the basis of the transport speed coinciding with the reference timing; target delay amount update process of updating a target delay amount, on the occurrence of change in the transport speed before the recording medium is transported by the target delay amount determined by the target delay amount determination process, the target delay amount being updated in response to the transport speed as changed; and ejection delay process of delaying timing of ejection of ink by the ink ejector on the basis of the target delay amount updated by the target delay amount update process.

If the transport speed is changed after the reference timing, the target delay amount is updated in response to the changed transport speed and ink is ejected on the basis of the updated target delay amount. This makes it possible to compensate for a landing position of ink appropriately in response to change in the transport speed.

Preferably, the inkjet printing apparatus further includes an encoder that outputs a pulse signal responsive to a transport speed of the recording medium transported by the transport unit. The speed calculation process is process of calculating the transport speed on the basis of the pulse signal.

The transport speed can be calculated on the basis of the pulse signal output from the encoder.

Preferably, the ejection controller includes: a reference timing signal generator that generates a reference timing signal indicating the reference timing; a sub-timing signal generator that generates a sub-timing signal having a shorter period than the reference timing signal; a target delay amount determiner that determines the target delay amount on the basis of the transport speed if the reference timing signal is acquired; and an ejection delay part that causes the ink ejector to eject ink on the basis of a sub-timing signal corresponding to the target delay amount. If the transport speed is changed before the recording medium is transported by the target delay amount, the target delay amount determiner updates the target delay amount in response to the transport speed as changed.

In response to change in the transport speed, timing of ejection of ink by the ink ejector can be delayed on the basis of the sub-timing signal having a shorter period than the reference timing signal.

Preferably, after the reference timing signal is acquired, the ejection delay part acquires a current delay amount by counting the number of pulses of the sub-timing signal, and causes the ink ejector to eject ink if the current delay amount reaches the target delay amount.

Counting the number of pulses of the sub-timing signal makes it possible to determine whether the target delay amount is reached.

Preferably, if the target delay amount determiner updates the target delay amount before the current delay amount reaches the target delay amount, the ejection delay part causes the ink ejector to eject ink on the basis of the target delay amount as updated.

If the transport speed is changed before the current delay amount reaches the target delay amount, ejection of ink is delayed on the basis of the target delay amount responsive to the changed transport speed. This makes it possible to eject ink by following timing conforming to the change in the transport speed.

Preferably, the target delay amount determiner determines the target delay amount by acquiring the transport speed in response to the sub-timing signal.

Speed information is acquired according to a period of generation of the sub-timing signal to determine the target delay amount. Thus, even if the transport speed is changed in a short period of time, it is still possible to eject ink by following timing appropriate for the change in the transport speed.

Preferably, if the transport speed is a speed on the increase, the target delay amount determiner reduces the target delay amount compared to the target delay amount determined if the transport speed is a speed on the decrease.

If the transport speed is a speed on the increase, the recording medium goes forward during flight time by a distance greater than a distance in a state where the transport speed is a speed on the decrease. For this reason, if the transport speed is a speed on the increase, the target delay amount is reduced compared to an amount determined if the transport speed is a speed on the decrease. By doing so, it becomes possible to compensate for a landing position of ink appropriately.

Preferably, the ejection controller determines the target delay amount on the basis of flight time from ejection of ink by the ink ejector to attachment of the ink to the recording medium.

As the target delay amount is determined on the basis of the flight time, a landing position of ink can be compensated for appropriately.

Preferably, the inkjet printing apparatus further includes a storage that stores a delay amount table defining correspondence between the transport speed and the target delay amount, and the ejection controller determines the target delay amount on the basis of the delay amount table.

The target delay amount can be determined on the basis of the delay amount table.

Preferably, the delay amount table defines the target delay amount for each of a plurality of zones of the transport speed, and the zones of the transport speed are defined on the basis of the flight time.

As the zones of the transport speed are defined on the basis of the flight time, the target delay amount can be defined in conformity with the flight time.

Preferably, the inkjet printing apparatus further includes a transport controller that controls a speed of transport of the recording medium by the transport unit. The storage stores an acceleration/deceleration table to be employed for increasing or decreasing of the transport speed by the transport controller. The acceleration/deceleration table defines correspondence between time and a transport speed. The ejection controller determines the target delay amount on the basis of the transport speed and the acceleration/deceleration table.

A landing position of ink can be compensated for appropriately in response to error in the amount of movement of the recording medium to be caused by increase or decrease of the transport speed of the recording medium.

The present invention is further directed to an inkjet printing method.

According to the present invention, the inkjet printing method includes the steps of: (a) transporting a recording medium in a prescribed transport direction; (b) determining a target delay amount corresponding to a transport distance of the recording medium in a period from generation of reference timing to ejection of ink by an ink ejector on the basis of a transport speed of the recording medium coinciding with the reference timing; (c) updating a target delay amount, on the occurrence of change in the transport speed before the recording medium is transported by the target delay amount determined by the step (b), the target delay amount being updated in response to the transport speed as changed; and (d) causing the ink ejector to eject ink on the basis of the target delay amount updated by the step (c).

These and other objects, features, aspects and advantages of the present invention will become more apparent from the following detailed description of the present invention when taken in conjunction with the accompanying drawings.

BRIEF DESCRIPTION OF THE DRAWINGS

FIG. 5 shows an example of a delay amount table;

DESCRIPTION OF THE PREFERRED EMBODIMENTS

Figure 1:
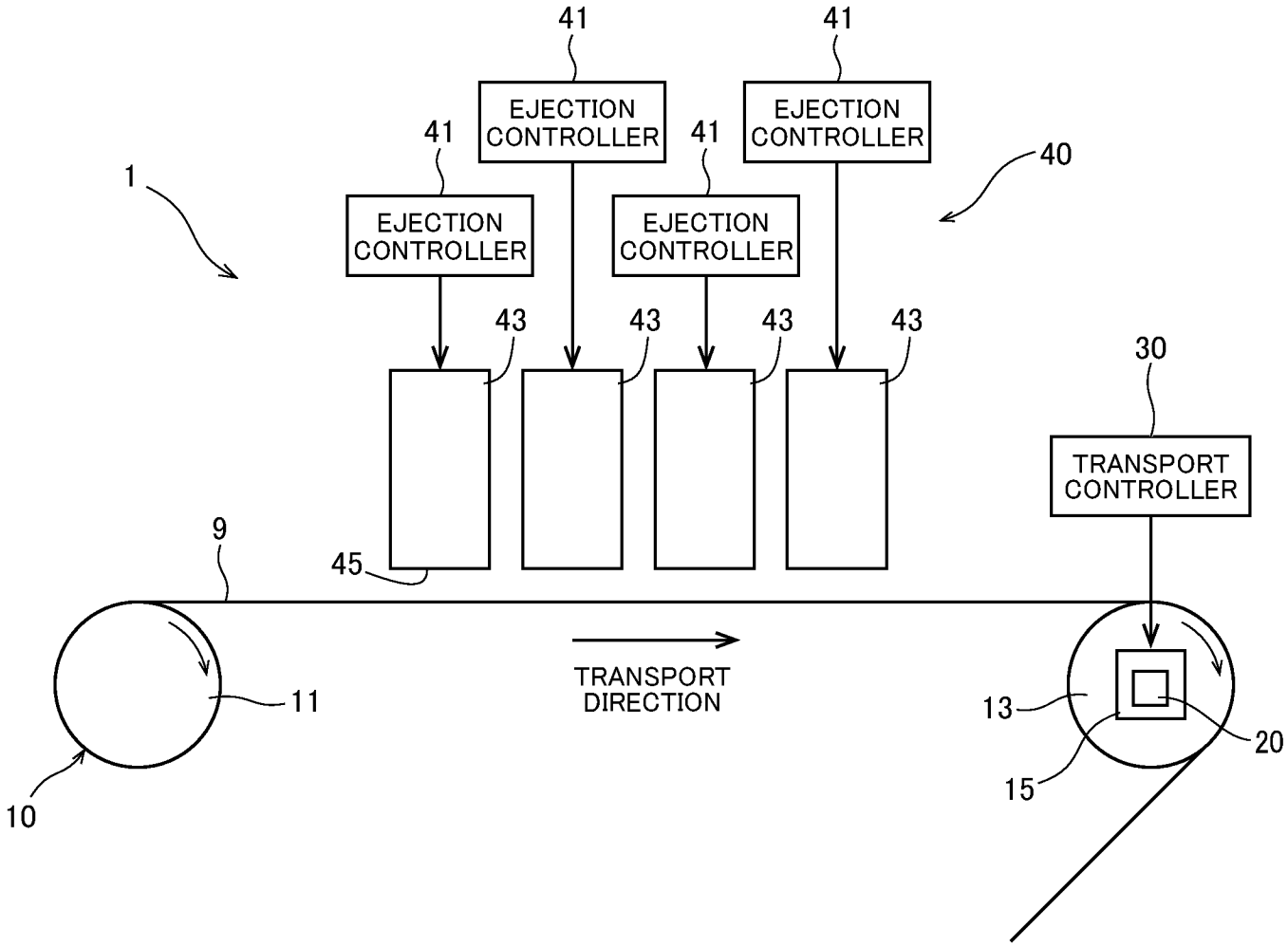
FIG. 1 shows the configuration of an inkjet printing apparatus according to a preferred embodiment.

A preferred embodiment of the present invention will be described below by referring to the drawings. Constituting elements in the preferred embodiment are described merely as examples, and the scope of the present invention is not intended to be limited only to these elements. To facilitate understanding, the size of each part or the number of such parts in the drawings may be illustrated in an exaggerated or simplified manner, if necessary.

1. Preferred Embodiment

FIG. 1 shows the configuration of an inkjet printing apparatus 1 according to a preferred embodiment. The inkjet printing apparatus 1 transports a recording medium 9 of an elongated strip-shape in a prescribed transport direction by a roll-to-roll system. The inkjet printing apparatus 1 ejects ink toward a surface of the recording medium 9 being transported to form an image on the surface of the recording medium 9. The recording medium 9 is paper or a film, for example. As shown in FIG. 1, the inkjet printing apparatus 1 includes a transport unit 10, an encoder 20, a transport controller 30, and a print unit 40.

The transport unit 10 includes a first roller 11, a second roller 13, and a transport motor 15. The first roller 11 and the second roller 13 each have an outer peripheral surface for supporting the back surface of the recording medium 9. The recording medium 9 is wound on the outer peripheral surface of the second roller 13. The transport motor 15 is connected to a rotary axis of the second roller 13. The transport motor 15 rotates the second roller 13 to move the recording medium 9 from the first roller 11 to the second roller 13.

The first roller 11 may be a roller to unwind the recording medium 9 wound in a roll shape. The second roller 13 may be a roller to wind the recording medium 9 into a roll shape. A plurality of auxiliary rollers for supporting the recording medium 9 may be arranged between the first roller 11 and the second roller 13 as viewed in the transport direction.

The encoder 20 outputs a pulse signal responsive to a transport speed of the recording medium 9 transported by the transport unit 10. The encoder 20 is attached to the transport motor 15, for example. The encoder 20 outputs the pulse signal each time the transport motor 15 rotates a predetermined angle. The encoder 20 may detect rotation of the second roller 13.

The transport controller 30 controls the transport motor 15 on the basis of the pulse signal output from the encoder 20 to control a transport speed of the recording medium 9 transported by the transport unit 10.

The print unit 40 includes four ejection controllers 41 and four heads 43 (ink ejectors). As shown in FIG. 1, the heads 43 each have an ejection surface 45 to face the upper surface (print intended surface) of the recording medium 9 transported by the transport unit 10. As shown in FIG. 1, the ejection surface 45 is substantially parallel to the upper surface of the recording medium 9.

Figure 2:
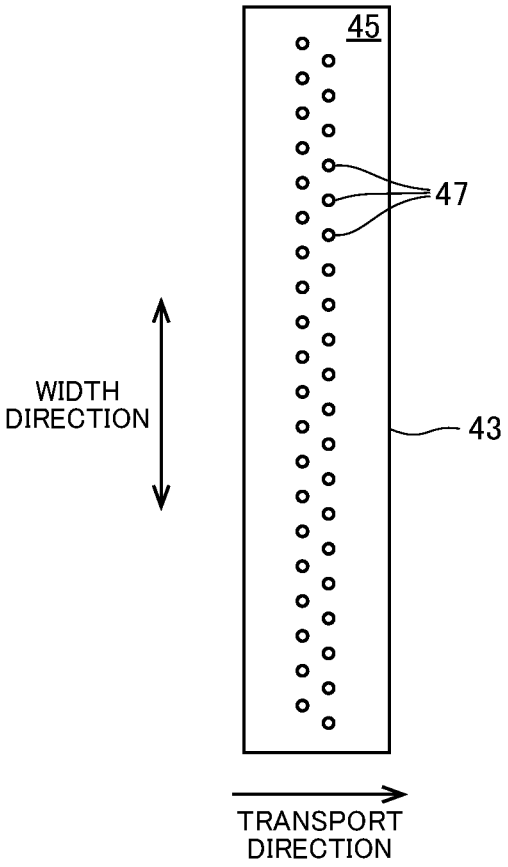
FIG. 2 shows an ejection surface of a head.

FIG. 2 shows the ejection surface 45 of the head 43. As shown in FIG. 2, the ejection surface 45 has a practically rectangular shape extending in a width direction perpendicular to the transport direction. The ejection surface 45 includes a plurality of nozzles 47 (ejection ports) for ejecting ink. The nozzles 47 are spaced uniformly in the width direction. The nozzles 47 arranged in the width direction form a plurality of columns (in this example, two columns) as viewed in the transport direction. The nozzles 47 in the first column are at positions shifted in the width direction from the nozzles 47 in the second column.

The head 43 forms an image corresponding to image data on the upper surface of the recording medium 9 by ejecting ink from each nozzle 47 onto the recording medium 9 transported by the transport unit 10. The head 43 includes a plurality of inkjet elements (not shown in the drawings) provided for corresponding ones of the nozzles 47. The inkjet element directs a jet of ink from the nozzle 47. The inkjet element is formed of an ink chamber storing ink and a piezoelectric element forming the wall surface of the ink chamber, for example. In response to application of a voltage, the piezoelectric element applies pressure to the ink in the ink chamber. In response to application of the pressure to the ink, the ink is jetted from the nozzle 47 communicating with the ink chamber.

As shown in FIG. 1, the four heads 43 are aligned at intervals in the transport direction. Each of the four heads 43 ejects ink corresponding to any one of four colors including black (K), cyan (C), magenta (M), and yellow (Y), for example. The colors ejected from the corresponding heads 43 are not limited to K, C, M, and Y. The number of the heads 43 is not limited to four but may be any of numbers from one to three, or five or more.

Figure 3:
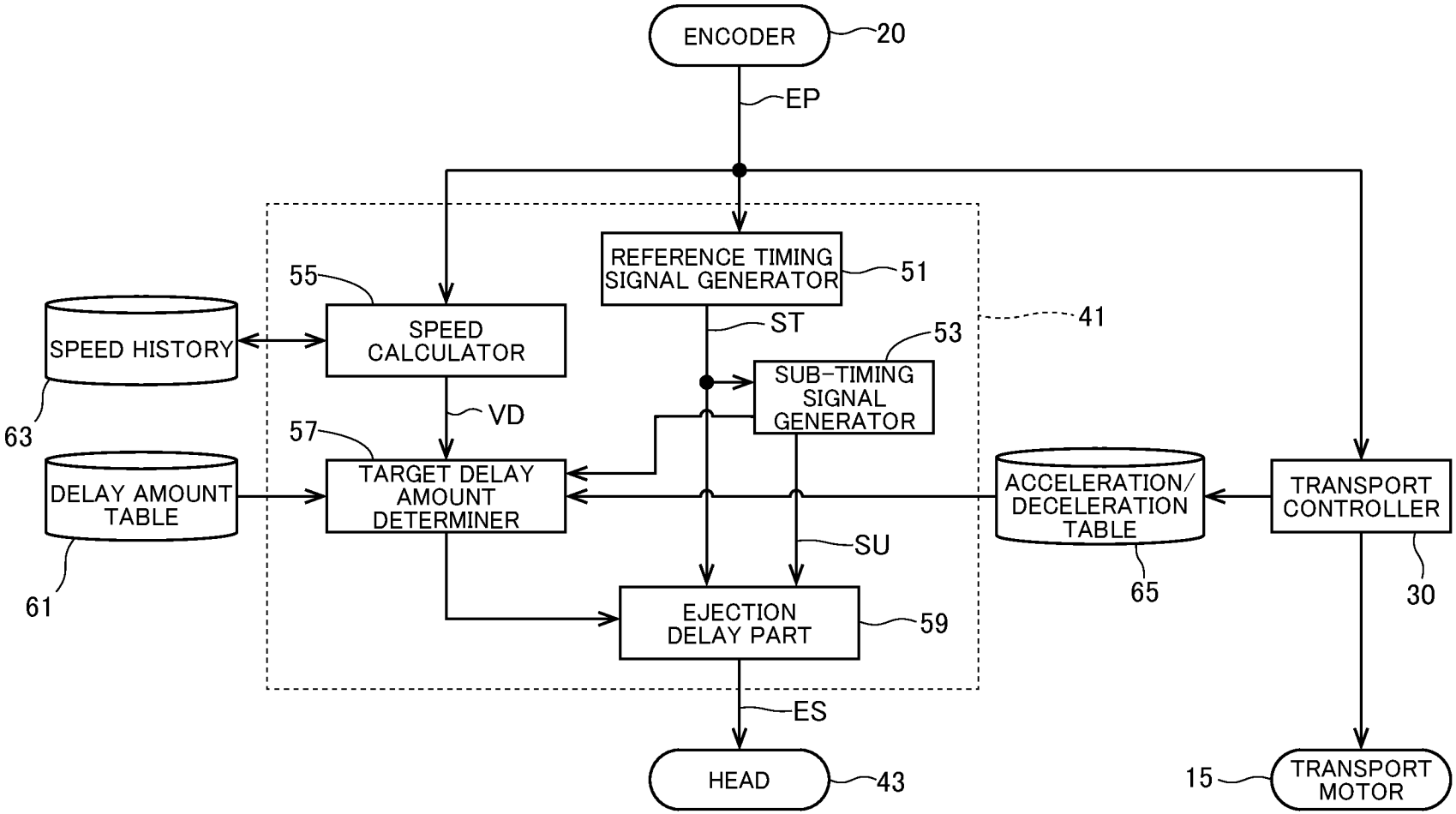
FIG. 3 shows the configuration of an ejection controller.

FIG. 3 shows the configuration of the ejection controller 41. The ejection controller 41 controls ejection of ink from each ejection port of the head 43. The ejection controller 41 includes a reference timing signal generator 51, a sub-timing signal generator 53, a speed calculator 55, a target delay amount determiner 57, and an ejection delay part 59. The ejection controller 41 can be configured using a dedicated circuit such as an application-specific integrated circuit (ASIC). Alternatively, the ejection controller 41 may be configured as a general computer including a processor such as a CPU and a RAM electrically connected to the processor, etc. Each function of the ejection controller 41 may be realized in response to operation of the processor according to a program.

Figure 4:
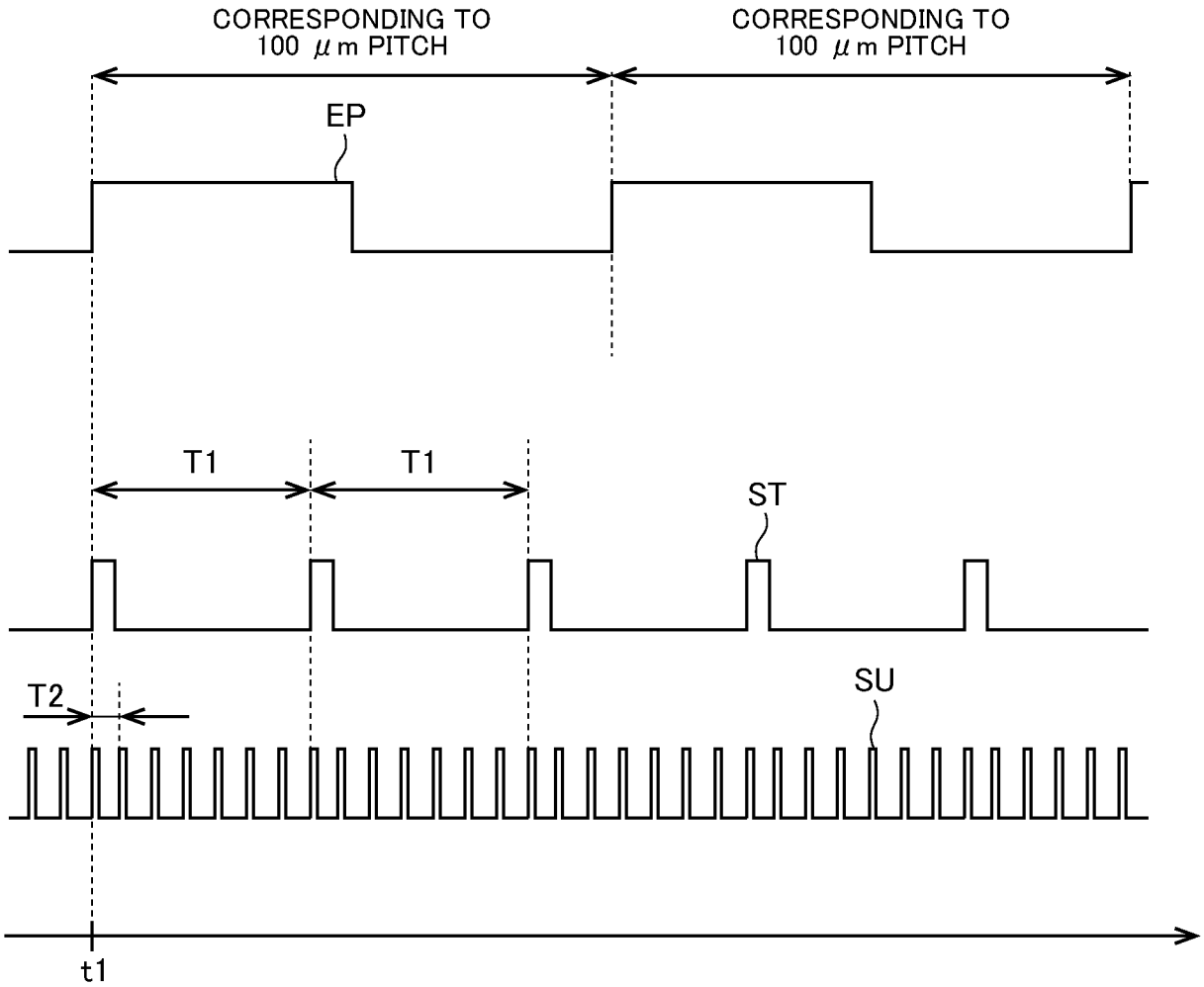
FIG. 4 shows signals generated by the ejection controller.

FIG. 4 shows signals generated by the ejection controller 41. In FIG. 4, a horizontal axis shows time. A pulse signal EP is output from the encoder 20 each time the recording medium 9 goes forward by a predetermined distance. As shown in FIG. 3, the encoder 20 outputs the pulse signal EP to the reference timing signal generator 51, the speed calculator 55, and the transport controller 30.

The reference timing signal generator 51 generates a reference timing signal ST on the basis of the pulse signal EP output from the encoder 20. As the reference timing signal ST is generated on the basis of the pulse signal EP, it is a periodic signal generated at a constant time interval corresponding to a print resolution independently of change in a transport speed of the recording medium 9. A period T1 of the reference timing signal ST may agree with time required for the recording medium 9 to go forward by one pitch of a print resolution while the recording medium 9 is transported at a constant reference transport speed. With a reference transport speed defined as Vs and a print resolution as 600 dpi (42 [μm] pitch), for example, the period T1 may agree with a value obtained by dividing 42 [μm] by Vs (=42 [μm]/Vs). The reference timing signal generator 51 outputs the generated reference timing signal ST to the sub-timing signal generator 53 and the ejection delay part 59.

If the recording medium 9 is transported at the constant reference transport speed and ink is ejected from the nozzle 47 of the head 43 by following timing indicated by the reference timing signal ST, a print resolution with an intended pitch is achieved in a resultant image. The reference timing signal ST is a signal indicating reference timing of ejection of ink by the head 43. Process of generating the reference timing signal ST performed by the reference timing signal generator 51 corresponds to process of generating the reference timing performed by the ejection controller 41.

If a transport speed of the recording medium 9 changes while ink is ejected in a cycle of the reference timing signal ST, displacement of a pitch is caused between landing positions of the ink on the recording medium 9. The reason for this is that, during time from ejection of the ink from the nozzle 47 of the head 43 to landing of the ink on the recording medium 9 (flight time), a distance of movement (movement amount) of the recording medium 9 changes in proportion to a transport speed of the recording medium 9. The occurrence of the displacement of the pitch between the landing positions may degrade image quality as a print result. For this reason, the ejection controller 41 performs process described later for making a lag (delay amount) from generation of a reference pulse of the reference timing signal ST to ejection of the ink by the head 43 variable in response to change in a transport speed of the recording medium 9, thereby compensating for a landing position of the ink. In this preferred embodiment, a delay amount is managed using the number of pulses of a sub-timing signal SU (this practically means the amount of transport the recording medium 9) as a scale.

The sub-timing signal generator 53 generates the sub-timing signal SU having a period T2 shorter than the period T1 of the reference timing signal ST. The sub-timing signal generator 53 may generate the sub-timing signal SU by multiplying the reference timing signal ST. The sub-timing signal SU shown in FIG. 4 is a signal generated by multiplying the reference timing signal ST by 8. As shown in FIG. 3, the sub-timing signal generator 53 outputs the generated sub-timing signal SU to the target delay amount determiner 57 and the ejection delay part 59.

The speed calculator 55 calculates a transport speed of the recording medium 9 on the basis of a moment when the pulse signal EP output from the encoder 20 is acquired. More specifically, the speed calculator 55 calculates a transport speed by dividing a pitch of output of the pulse signals EP from the encoder 20 (in the example of FIG. 4, 100 μm) by a time interval between two consecutive pulse signals EP. The speed calculator 55 outputs speed information VD containing the calculated transport speed to the target delay amount determiner 57. The speed calculator 55 may output the reciprocal of the time interval between the two pulse signals EP as the speed information VD to the target delay amount determiner 57.

On the basis of the speed information VD output from the speed calculator 55, the target delay amount determiner 57 determines a target delay amount. The target delay amount is information indicating the amount of delay from generation of a reference pulse of the reference timing signal ST to ejection of ink by the head 43 through the nozzle 47 using the amount of transport of the recording medium 9 as a reference. In the example of FIG. 4, the target delay amount means a transport distance of the recording medium 9 in a period from a time t1 when a first pulse of the reference timing signal ST is generated to a moment when the ink is actually ejected. In this preferred embodiment, the target delay amount is managed in terms of the number of pulses of the sub-timing signal SU. As described above, the sub-timing signal SU is a signal generated by multiplying the reference timing signal ST that is generated in synchronization with transport of the recording medium 9. For this reason, it is reasonable to manage the target delay amount (the amount of transport of the recording medium 9) using the number of pulses of the sub-timing signal SU as a scale.

The inkjet printing apparatus 1 may include a storage storing a delay amount table 61. The target delay amount determiner 57 may determine a target delay amount on the basis of the delay amount table 61. The delay amount table 61 is information defining correspondence between a transport speed and a target delay amount. A target delay amount corresponding to each transport speed is determined on the basis of preparatory experiment or theoretical calculation such as simulation.

FIG. 5 shows an example of the delay amount table 61. As shown in FIG. 5, the delay amount table 61 contains a target delay amount defined for each of different zones of a transport speed. In the example shown in FIG. 5, a target delay amount is defined in terms of the number of pulses of the sub-timing signal SU. For example, if a transport speed is from 37 to 42 mpm, a target delay amount means a distance by which the recording medium 9 is transported while 20 pulses of the sub-timing signal SU (=T2×20) are generated. Also, if a transport speed is from 42 to 47 mpm, a target delay amount means a distance by which the recording medium 9 is transported while 19 pulses of the sub-timing signal SU (=T2×19) are generated. The target delay amount determiner 57 acquires a target delay amount corresponding to a zone covering a transport speed acquired by the speed calculator 55 by referring to the delay amount table 61. The target delay amount determiner 57 outputs the determined target delay amount to the ejection delay part 59.

The ejection delay part 59 causes the head 43 to eject ink on the basis of the sub-timing signal SU corresponding to the target delay amount. More specifically, the ejection delay part 59 counts the number of pulses of the sub-timing signal SU after acquisition of the reference timing signal ST, thereby acquiring a current delay amount (the amount of transport of the recording medium 9 after acquisition of the reference timing signal ST). If the current delay amount reaches the target delay amount, the ejection delay part 59 causes the head 43 to eject the ink. The ejection delay part 59 outputs an ejection signal ES to each inkjet element provided at the head 43. Each inkjet element ejects the ink from the nozzle 47 in response to the input ejection signal ES.

Figure 6:
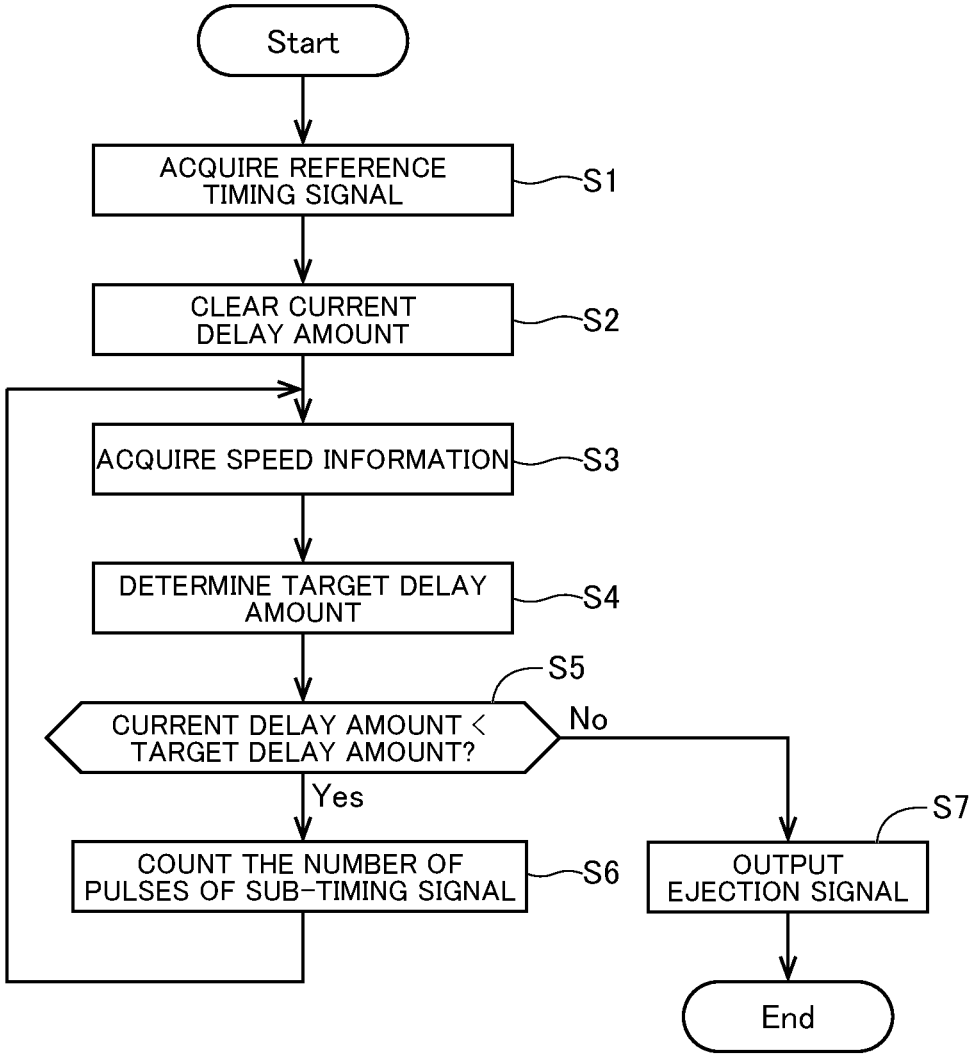
FIG. 6 shows a flow of process performed by the ejection controller.

FIG. 6 shows a flow of process performed by the ejection controller 41. First, the ejection delay part 59 acquires the reference timing signal ST (signal acquisition process S1). After the reference timing signal ST is acquired by the signal acquisition process S1, the ejection delay part 59 clears a current delay amount (clear process S2).

The target delay amount determiner 57 acquires the speed information VD according to the period of the sub-timing signal SU output from the sub-timing signal generator 53 (speed information acquisition process S3). In the speed information acquisition process S3, the target delay amount determiner 57 acquires the latest speed information VD output from the speed calculator 55. Then, the target delay amount determiner 57 determines a target delay amount on the basis of the acquired speed information VD (target delay amount determination process S4). The target delay amount is information indicating the amount of transport of the recording medium 9 in terms of the number of pulses of the sub-timing signal SU (see FIG. 5). The target delay amount determiner 57 outputs the determined target delay amount to the ejection delay part 59.

In response to acquisition of the target delay amount, the ejection delay part 59 determines whether the current delay amount is less than the target delay amount (determination process S5). As described above, the ejection delay part 59 counts the number of pulses of the sub-timing signal SU output from the sub-timing signal generator 53, and acquires the counted number of pulses of the sub-timing signal SU as the current delay amount. Namely, the current delay amount is the number of pulses of the sub-timing signal SU counted after acquisition of the reference timing signal ST by the ejection delay part 59, which corresponds to the amount of transport of the recording medium 9 after acquisition of the reference timing signal ST by the ejection delay part 59.

If the current delay amount is determined to be less than the target delay amount in the determination process S5 (if Yes), the ejection delay part 59 counts the number of pulses of the sub-timing signal SU (count process S6). More specifically, in the count process S6, the ejection delay part 59 is put on standby until the sub-timing signal generator 53 outputs one pulse of the sub-timing signal SU. When the sub-timing signal SU is acquired, the ejection delay part 59 increments the counted number of pulses of the sub-timing signal SU indicating the current delay amount by one.

After the ejection delay part 59 performs the count process S6, the target delay amount determiner 57 performs the speed information acquisition process S3 and the target delay amount determination process S4. Specifically, the target delay amount determiner 57 acquires the speed information VD according to the period of the sub-timing signal SU, and determines a target delay amount on the basis of the acquired speed information VD. If the speed information VD acquired again is the same as the previous speed information VD (namely, if a transport speed remains the same), the target delay amount determiner 57 outputs a target delay amount same as the previous amount again to the ejection delay part 59. If the speed information VD acquired again changes from the previous speed information VD (namely, if a transport speed is changed), the target delay amount determiner 57 outputs a new target delay amount based on the changed speed information VD to the ejection delay part 59.

If the target delay amount is changed, the ejection delay part 59 updates the target delay amount and performs the determination process S5 on the basis of the updated target delay amount. In this way, each time one pulse of the sub-timing signal SU is counted, the ejection delay part 59 compares the new target delay amount and the current delay amount to each other.

If the current delay amount is determined to reach the target delay amount in the determination process S5 (if No), the ejection delay part 59 outputs the ejection signal ES to the head 43 (ejection signal output process S7). In response to output of the ejection signal ES, ink is ejected from each nozzle 47 of the head 43.

Figure 7:
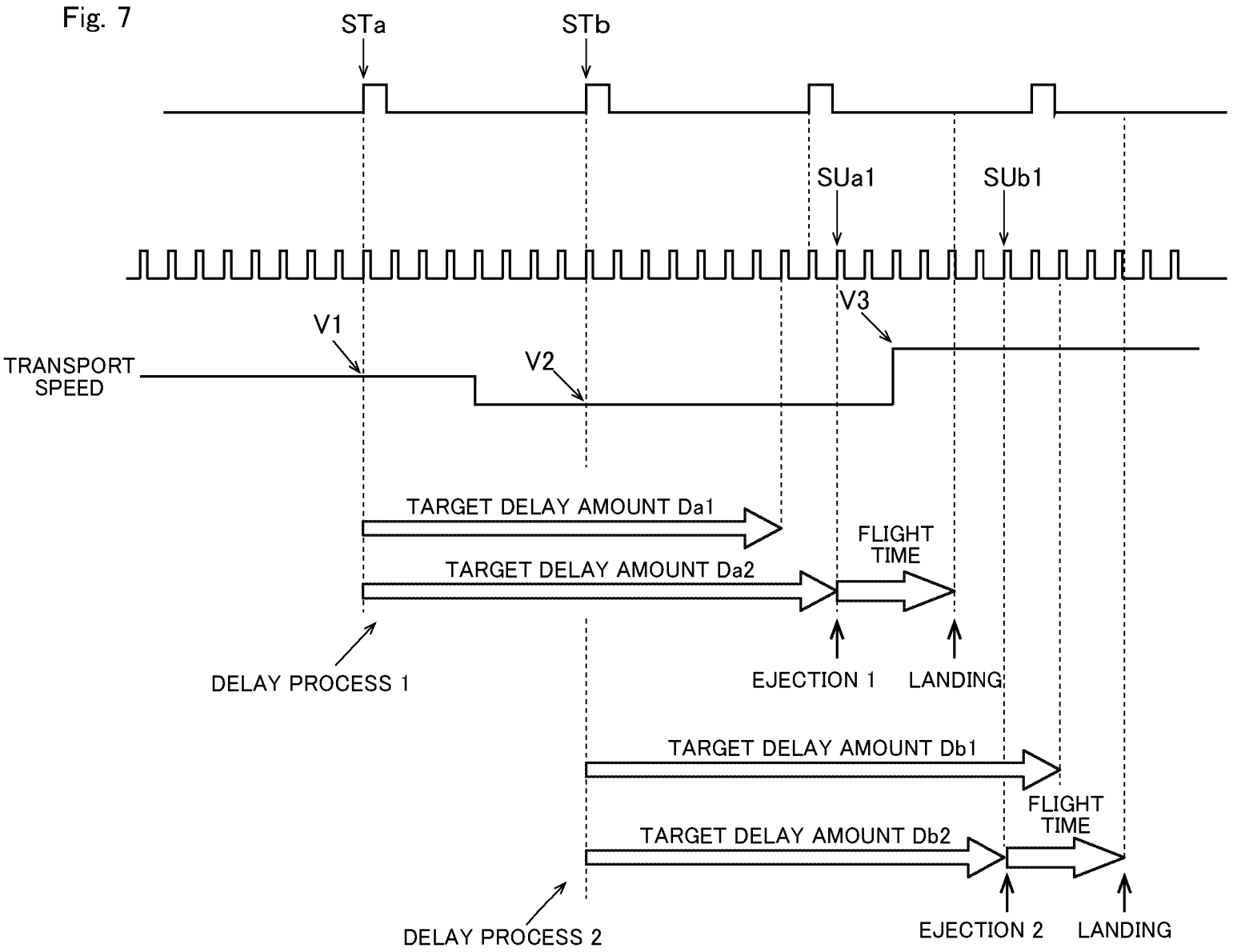
FIG. 7 conceptually explains ejection of ink based on a target delay amount.

FIG. 7 conceptually explains ejection of ink based on a target delay amount. Process described below by referring to FIG. 7 includes delay process 1 responsive to output of a reference timing signal STa and delay process 2 responsive to output of a reference timing signal STb.

As shown in FIG. 7, on the basis of a transport speed V1 coinciding with reference timing conforming to the reference timing signal STa, the target delay amount determiner 57 determines a target delay amount Da1. If a transport speed coinciding with the reference timing is 64 mpm, for example, the target delay amount Da1 corresponds to 15 pulses of the sub-timing signal SU (see FIG. 5). If the transport speed V1 is maintained, the ejection delay part 59 counts the number of pulses of the sub-timing signal SU in a period from acquisition of the reference timing signal STa to reach of the target delay amount Da1, and proceeds to ejection of ink on the basis of the sub-timing signal SU corresponding to the target delay amount Da1. As shown in FIG. 7, if the transport speed decreases from V1 to V2 (V1>V2) before reach of the target delay amount Da1, the target delay amount determiner 57 outputs a target delay amount Da2 responsive to the transport speed V2 to the ejection delay part 59, and the ejection delay part 59 updates the target delay amount from Da1 to Da2. In this case, the ejection delay part 59 causes the head 43 to eject ink at a moment when the ejection delay part 59 acquires a sub-timing signal SUal corresponding to the target delay amount Da2 (at a moment when the target delay amount Da2 is reached after acquisition of the reference timing signal STa). By doing so, the ejected ink is caused to land on the recording medium 9 after passage of predetermined flight time.

If the reference timing signal STb is acquired, the ejection delay part 59 performs the delay process 2 similar to the delay process 1 performed in response to acquisition of the previous reference timing signal STa. The ejection delay part 59 performs the delay process 2 in parallel with the delay process 1. In response to acquisition of the reference timing signal STb, the ejection delay part 59 also delays ejection until reach of a target delay amount Db1 responsive to the transport speed (=V2) at the moment of output of the reference timing signal STb. In the example shown in FIG. 7, however, the transport speed increases from V2 to V3 before reach of the target delay amount Db1. In this case, the ejection delay part 59 updates the target delay amount to Db2 responsive to the transport speed V3. The target delay amount Db2 is less than the target delay amount Db1. The ejection delay part 59 causes the head 43 to eject ink at a moment when the sub-timing signal SUb1 corresponding to the target delay amount Db2 is acquired. By doing so, the ejected ink is caused to land on the recording medium 9 after passage of predetermined flight time.

As described above, the ejection controller 41 determines a target delay amount on the basis of a transport speed coinciding with reference timing, and proceeds to ejection of ink at a moment when the recording medium 9 moves by an amount indicated by the target delay amount. This makes it possible to compensate for a landing position appropriately in response to the amount of movement of the recording medium 9 during flight of the ink.

If a transport speed of the recording medium 9 is changed in a period from the reference timing to movement of the recording medium 9 by the amount indicated by the target delay amount, the ejection delay part 59 updates the target delay amount in response to the changed transport speed, and proceeds to ejection of ink at a moment when the updated target delay amount is reached. Thus, even on the occurrence of change in the transport speed after the reference timing, it still becomes possible to compensate for a landing position appropriately.

As shown in FIG. 3, the speed calculator 55 may incorporate information indicating whether a calculated transport speed is on the increase or on the decrease into the speed information VD. The speed calculator 55 may store a history of calculated transport speeds as speed history information 63 into the storage. The speed calculator 55 compares a newly calculated transport speed and a previously calculated transport speed to each other. The speed calculator 55 may incorporate information indicating a state during acceleration in response to increase in the transport speed and information indicating a state during deceleration in response to decrease in the transport speed into the speed information VD.

The target delay amount determiner 57 may determine a target delay amount in response to whether a transport speed indicated by the speed information VD is on the increase or on the decrease. If the transport speed is on the increase, the target delay amount determiner 57 may determine a smaller value as a target delay amount than a value determined if the transport speed is on the decrease, for example. If the transport speed is on the increase, the recording medium 9 is moved by a greater amount during flight time than an amount of movement during decrease of the transport speed. In this case, compared to decrease in the transport speed, the amount of movement of the recording medium 9 becomes greater during the flight time. For this reason, in a state during acceleration, the target delay amount is reduced (an ejection period is shortened) compared to a state during deceleration, thereby compensating for a landing position of ink appropriately.

The delay amount table 61 may include a table for acceleration responsive to a state during acceleration and a table for deceleration responsive to a state during deceleration. The target delay amount determiner 57 may determine a target delay amount using the table for acceleration in a state during acceleration and using the table for deceleration in a state during deceleration.

<Determination of Target Delay Amount Responsive to Flight Time>

Figure 8:
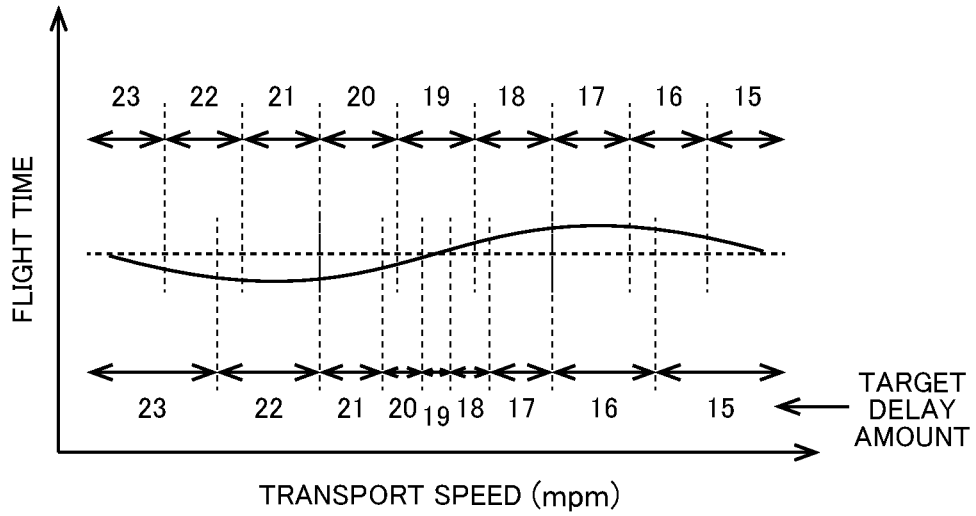
FIG. 8 shows a relationship between a transport speed and flight time.

FIG. 8 shows a relationship between a transport speed and flight time. Ideally, flight time of ink is constant independently of a transport speed of the recording medium 9. As shown in FIG. 8, however, the flight time may change in response to the transport speed. If the ink is ejected in a period responsive to the transport speed, resonance may be caused by periodic deformation of the piezoelectric element in the ink chamber, for example. The occurrence of the resonance changes a speed of ejection of the ink, causing a probability of change in the flight time.

As described above, if the flight time changes in response to the transport speed, the target delay amount determiner 57 may determine a target delay amount in response to the flight time. In this case, a target delay amount defined in the delay amount table 61 may be set in response to the flight time, for example. As shown in FIG. 8, for example, zones of the transport speed defined in the delay amount table 61 may not be set at constant intervals but may be varied in conformity with the flight time. This makes it possible to determine a target delay amount appropriately in conformity with the flight time in each zone of the transport speed. By doing so, the target delay amount is determined in conformity with variations of the flight time responsive to the transport speed, thereby compensating for a landing position of ink appropriately.

<Determination of Target Delay Amount Responsive to Acceleration/Deceleration>

Figure 9:
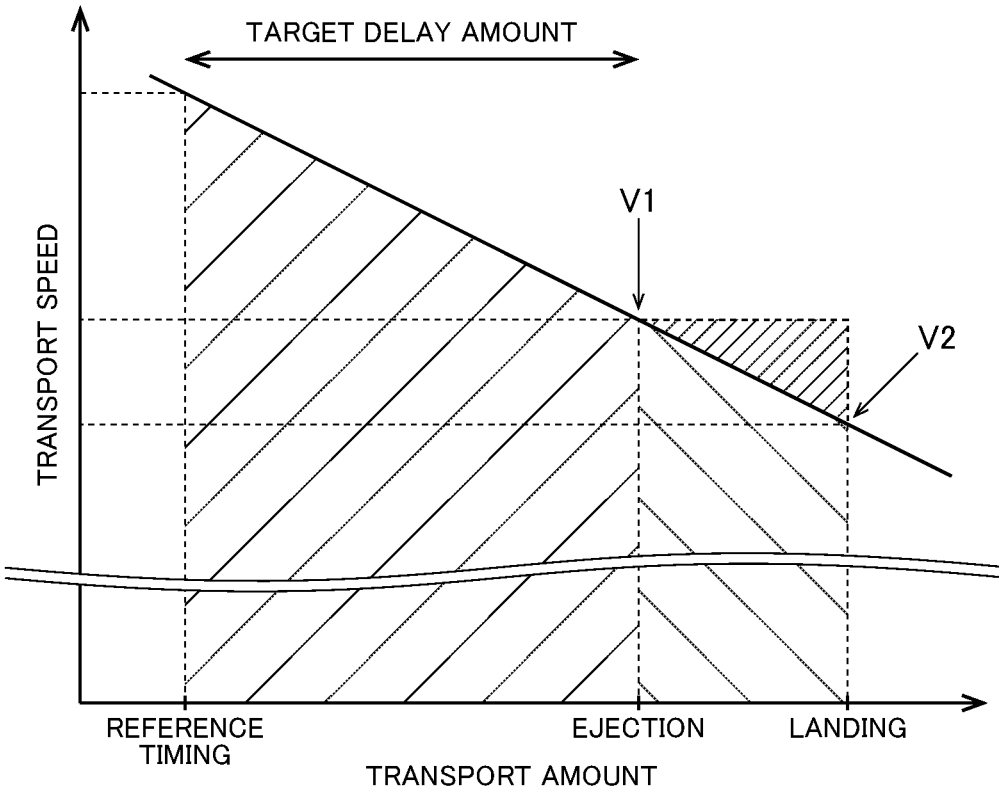
FIG. 9 shows a transport speed of a recording medium during deceleration.

FIG. 9 shows a transport speed of the recording medium 9 during deceleration. As shown in FIG. 9, if the transport speed decreases from V1 to V2 during flight time of ink, error is caused in the amount of movement of the recording medium 9 during the flight time from a state where the transport speed is constantly V1. In FIG. 9, this error in the amount of movement is expressed by an area indicated as a hatched triangle. As a speed gradient (an acceleration) increases, the error in the amount of movement becomes greater. The target delay amount determiner 57 may determine a target delay amount on the basis of such error in the amount of movement.

For example, the speed calculator 55 may incorporate information indicating an acceleration into the speed information VD output to the target delay amount determiner 57.

The speed calculator 55 may acquire the acceleration by referring to the speed history information 63. The target delay amount determiner 57 may determine a target delay amount on the basis of the acceleration incorporated in the speed information VD. A delay amount table defining a target delay amount responsive to an acceleration may be prepared in advance.

<Determination of Target Delay Amount Responsive to Speed Curve>

Figure 10:
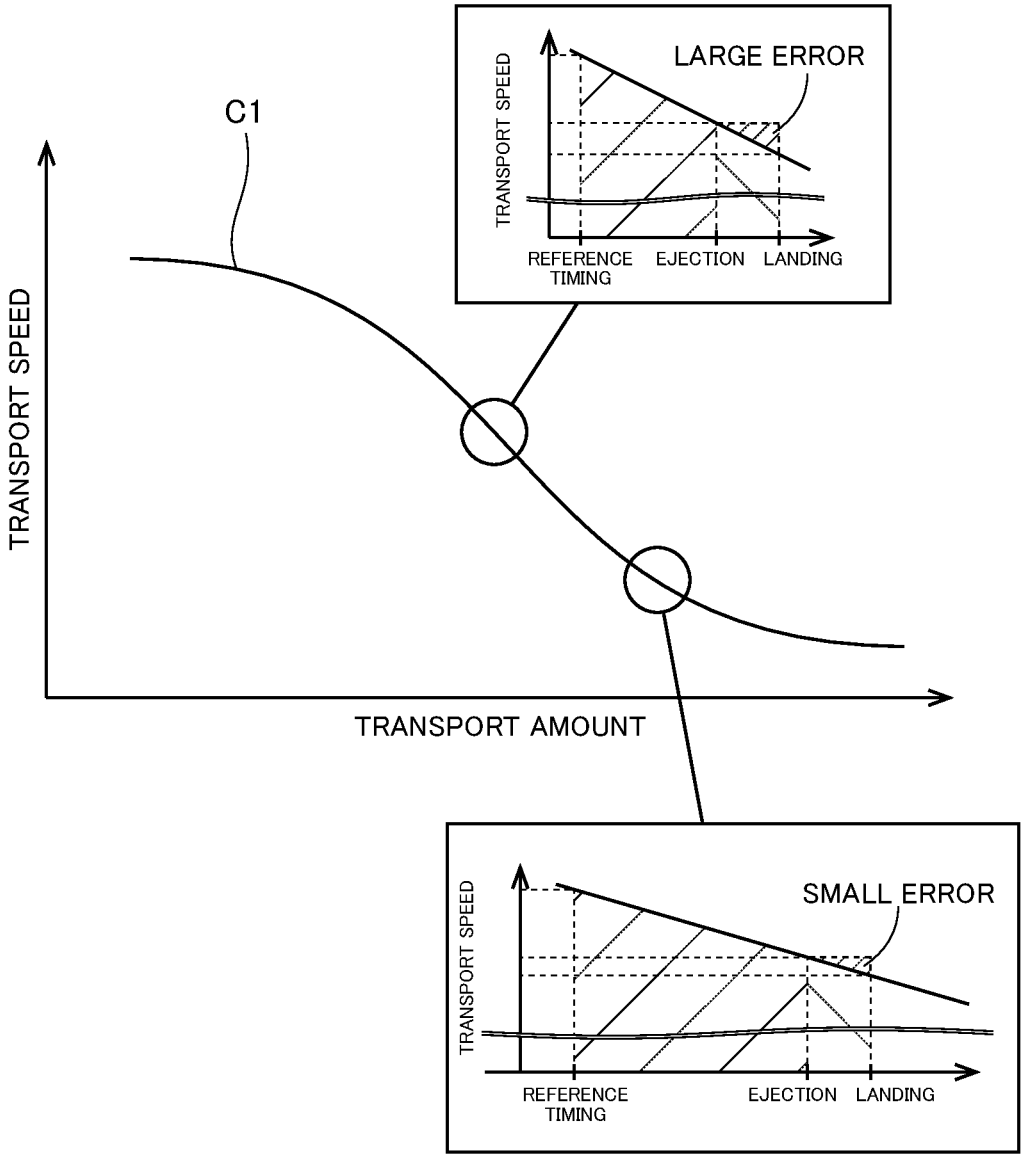
FIG. 10 shows an example of a deceleration curve.

FIG. 10 shows an example of a deceleration curve C1. As shown in FIG. 3, the transport controller 30 may employ an acceleration/deceleration table 65 in controlling a transport speed. The acceleration/deceleration table 65 contains a speed curve defined during increase or decrease of a transport speed. The transport controller 30 controls the transport motor 15 in such a manner that the transport speed follows the defined speed curve. The deceleration curve C1 shown in FIG. 10 is an example of the speed curve defined in the acceleration/deceleration table 65.

If the transport speed is decreased by following the deceleration curve C1, the error in the amount of movement described by referring to FIG. 9 (triangular area) changes between speed zones of the deceleration curve C1. As shown in FIG. 10, a greater gradient (a greater acceleration) of the deceleration curve C1 results in greater error in the amount of movement, for example. Thus, the target delay amount determiner 57 may determine a target delay amount in response to a speed zone of the speed curve. This makes it possible to compensate for a landing position appropriately in response to error in the amount of movement.

If the target delay amount determiner 57 determines a target delay amount in response to a speed zone of the speed curve, the target delay amount determiner 57 may acquire the acceleration/deceleration table 65 as shown in FIG. 3. Then, on the basis of the acquired acceleration/deceleration table 65, the target delay amount determiner 57 may identify a speed zone of the speed curve corresponding a transport speed calculated by the speed calculator 55. The delay amount table 61 defining a target delay amount responsive to a speed zone of the speed curve may be prepared in advance.

While the invention has been shown and described in detail, the foregoing description is in all aspects illustrative and not restrictive. It is therefore understood that numerous modifications and variations can be devised without departing from the scope of the invention.

What is claimed is:

1. An inkjet printing apparatus comprising:

a transport unit that transports a recording medium in a prescribed transport direction;

an ink ejector that ejects ink toward said recording medium transported by said transport unit; and an ejection controller that causes said ink ejector to eject ink, wherein said ejection controller comprises:

a reference timing signal generator that generates a reference timing signal indicating a reference timing; and a sub-timing signal generator that generates a sub-timing signal having a shorter period than said reference timing signal, said ejection controller performs process comprising:

speed calculation process of calculating a transport speed of said recording medium;

target delay amount determination process of determining a target delay amount corresponding to a transport distance of said recording medium in a period from generation of said reference timing to ejection of ink by said ink ejector on the basis of said transport speed coinciding with said reference timing;

speed information acquisition process of acquiring speed information indicating said transport speed calculated by said speed calculation process on the basis of said sub-timing signal;

target delay amount update process of updating said target delay amount to a new target delay amount, on the occurrence of change in said transport speed indicating by said speed information acquired by said speed information acquisition process after a time at which said reference timing signal is generated and before said recording medium is transported by said target delay amount determined by said target delay amount determination process, the target delay amount being updated in response to said transport speed as changed; and ejection delay process of delaying timing of ejection of ink by said ink ejector on the basis of said sub-timing signal corresponding to said target delay amount updated by said target delay amount update process.

2. The inkjet printing apparatus according to claim 1, further comprising;

an encoder that outputs a pulse signal responsive to a transport speed of said recording medium transported by said transport unit, wherein said speed calculation process is process of calculating said transport speed on the basis of said pulse signal.

3. The inkjet printing apparatus according to claim 2, wherein said ejection controller comprises:

a target delay amount determiner that determines said target delay amount on the basis of said transport speed if said reference timing signal is acquired; and an ejection delay part that causes said ink ejector to eject ink on the basis of a sub-timing signal corresponding to said target delay amount, and if said transport speed is changed before said recording medium is transported by said target delay amount, said target delay amount determiner updates said target delay amount in response to said transport speed as changed.

4. The inkjet printing apparatus according to claim 3, wherein after said reference timing signal is acquired, said ejection delay part acquires a current delay amount by counting the number of pulses of said sub-timing signal, and causes said ink ejector to eject ink if said current delay amount reaches said target delay amount.

5. The inkjet printing apparatus according to claim 4, wherein if said target delay amount determiner updates said target delay amount before said current delay amount reaches said target delay amount, said ejection delay part causes said ink ejector to eject ink on the basis of said target delay amount as updated.

6. The inkjet printing apparatus according to claim 3, wherein said target delay amount determiner determines said target delay amount by acquiring said transport speed in response to said sub-timing signal.

7. The inkjet printing apparatus according to claim 3, wherein if said transport speed is a speed on the increase, said target delay amount determiner reduces said target delay amount compared to said target delay amount determined if said transport speed is a speed on the decrease.

8. The inkjet printing apparatus according to claim 1, wherein said ejection controller determines said target delay amount on the basis of flight time from ejection of ink by said ink ejector to attachment of the ink to said recording medium.

9. The inkjet printing apparatus according to claim 8, further comprising:

a storage that stores a delay amount table defining correspondence between said transport speed and said target delay amount, wherein said ejection controller determines said target delay amount on the basis of said delay amount table.

10. The inkjet printing apparatus according to claim 9, wherein said delay amount table defines said target delay amount for each of a plurality of zones of said transport speed, and the zones of said transport speed are defined on the basis of said flight time.

11. The inkjet printing apparatus according to claim 9, further comprising:

a transport controller that controls a speed of transport of said recording medium by said transport unit, wherein said storage stores an acceleration/deceleration table to be employed for increasing or decreasing of said transport speed by said transport controller, said acceleration/deceleration table defines correspondence between time and a transport speed, and said ejection controller determines said target delay amount on the basis of said transport speed and said acceleration/deceleration table.

* * * * *